US010786920B2

(12) United States Patent
Roberts

(10) Patent No.: US 10,786,920 B2
(45) Date of Patent: Sep. 29, 2020

(54) MOBILE RIGID INSULATION BOARD SCORER

(71) Applicant: CentiMark Corporation, Canonsburg, PA (US)

(72) Inventor: Joshua Roberts, Hastings, MI (US)

(73) Assignee: Centimark Corporation, Canonsburg, PA (US)

( * ) Notice: Subject to any disclaimer, the term of this patent is extended or adjusted under 35 U.S.C. 154(b) by 0 days.

(21) Appl. No.: 14/703,114

(22) Filed: May 4, 2015

(65) Prior Publication Data

US 2016/0325452 A1 Nov. 10, 2016

(51) Int. Cl.
*B26D 3/08* (2006.01)
*B26D 1/16* (2006.01)

(52) U.S. Cl.
CPC ..... *B26D 3/085* (2013.01); *B26D 1/165* (2013.01)

(58) Field of Classification Search
CPC ..... Y10T 83/0333; Y10T 83/0348; Y10T 83/0356; Y10T 83/0363; Y10T 83/037; Y10T 83/0378; Y10T 83/0393; Y10T 83/02; Y10T 83/0215; Y10T 83/0222; Y10T 83/0341; B26D 3/08; B26D 3/085; B26D 1/16; B26D 1/165; B26D 1/185
See application file for complete search history.

(56) References Cited

U.S. PATENT DOCUMENTS 71,048 A * 11/1867 Orth ..... B26D 7/2635 83/864
2,120,920 A * 6/1938 Masters ..... B26D 3/085 493/352
2,139,890 A * 12/1938 Fitchett ..... B26D 3/085 33/37
2,225,630 A * 12/1940 Gilbert ..... B31B 1/25 493/372
2,305,536 A * 12/1942 Langston ..... B26D 1/225 83/399
3,314,339 A * 4/1967 Guffy ..... B26D 3/085 493/403
3,570,350 A * 3/1971 Fogg ..... B26D 3/08 83/404
3,748,937 A * 7/1973 Long ..... B65H 45/22 271/279
3,821,911 A * 7/1974 Seme ..... B21D 28/10 83/51
3,961,547 A * 6/1976 Shainberg ..... B23D 35/008 74/424.78
4,224,854 A * 9/1980 Malacheski ..... B23Q 9/0014 83/455
5,220,858 A * 6/1993 Allen ..... B26D 3/085 156/268
2004/0045427 A1* 3/2004 Kang ..... B26F 1/44 83/863
2004/0159693 A1* 8/2004 Adachi ..... B26D 5/02 225/3

(Continued)

FOREIGN PATENT DOCUMENTS

DE 102013218368 * 3/2015 ..... A22C 17/12

*Primary Examiner* — Jennifer B Swinney
(74) *Attorney, Agent, or Firm* — Buchanan Ingersoll & Rooney PC

(57) ABSTRACT

A board scoring device for insulation board that is mobile enough to be carried on a roof and can easily score the top and bottom surfaces to be separated into multiple boards.

15 Claims, 5 Drawing Sheets

(56) References Cited

U.S. PATENT DOCUMENTS

| | | | | |
|---|---|---|---|---|
| 2009/0100978 | A1* | 4/2009 | von Freden | B65H 45/30<br>83/883 |
| 2013/0119106 | A1* | 5/2013 | Moyal | B28D 1/225<br>225/2 |

* cited by examiner

MOBILE RIGID INSULATION BOARD SCORER

FIELD OF THE INVENTION

This invention relates to an apparatus that is used to place scoring lines in boards, particularly insulation boards for roofing, so the larger board may be separated along the scoring lines. The invention can easily be carried or transferred to roofs for use.

BACKGROUND OF THE INVENTION

There exists a need for a mobile rigid insulation board scorer that can be carried on a roof and set up by deploying or unfolding a set of legs.

There exists a need for a board scorer whereby the user can place a rigid insulation board ("board") adjacent a guide, then the board can be displaced through the scorer.

There is a need for a board scorer that may have a blade (rolling or static) that can cut into the board on both the top and bottom side as it is moving through the board scorer.

There is a need for a board scorer blade having a nylon spacer that may be disposed immediately adjacent to the blade to disperse pressure from adjacent the blade to reduce or eliminate further deformation of the board.

There is a need for a board scorer that has multiple blades spaced apart to score the board in separate sections.

Then the board can be moved to its desired location and then impacted or hit near the scoring line to break the board apart.

Multiple embodiments of the system are disclosed herein. It will be understood that other objects and purposes of the invention, and variations thereof, will be apparent upon reading the following specification and inspecting the accompanying drawings.

SUMMARY OF THE INVENTION

One aspect of the present invention is a board scorer, comprising: an upper blade; a lower blade; said upper blade slidably disposed on an upper arm; said lower blade slidably disposed on a lower arm; whereby an upper surface of a board is scored and a lower surface of said board is scored when displaced through the board scorer and between said upper blade and said lower blade.

Another aspect of the present invention is a board scorer, comprising: Multiple upper blades; multiple lower blades; said upper blades slidably disposed on an upper arm; said lower blades slidably disposed on a lower arm; whereby an upper surface of a board is scored and a lower surface of said board is scored when displaced through the board scorer and between said upper blade and said lower blade; a measuring device disposed near said lower arm; two bodies secured to a base separated by a distance to define a channel; a first body disposed in front of a second body; a support extending upwardly having a height adjustment means whereby said upper arm can be positioned at different distances from said lower arm; a spacer disposed leftwardly and rightwardly and immediately adjacent to said upper blade and to said lower blade; a guide rail is disposed securely on the left side of the board scorer and another guide rail is securely disposed on the right side of the board scorer to guide a board when displaced through said upper blade and said lower blade.

Another aspect of the present invention is a board scorer, consisting of: three upper blades; three lower blades; said upper blades slidably disposed on an upper arm; said lower blades slidably disposed on a lower arm; whereby an upper surface of a board is scored and a lower surface of said board is scored when displaced through the board scorer and between said upper blade and said lower blade; a measuring device disposed near said lower arm; two bodies secured to a base separated by a distance to define a channel; a first body disposed in front of a second body; a support extending upwardly having a height adjustment means whereby said upper arm can be positioned at different distances from said lower arm; a spacer disposed leftwardly and rightwardly and immediately adjacent to said upper blade and to said lower blade; a guide rail is disposed securely on the left side of the board scorer and another guide rail is securely disposed on the right side of the board scorer to guide a board when displaced through said upper blade and said lower blade.

These and other features, aspects and advantages of the present invention will become better understood with reference to the following drawings, description and claims.

DETAILED DESCRIPTION OF THE INVENTION

Reference Numerals List

Figure 1:
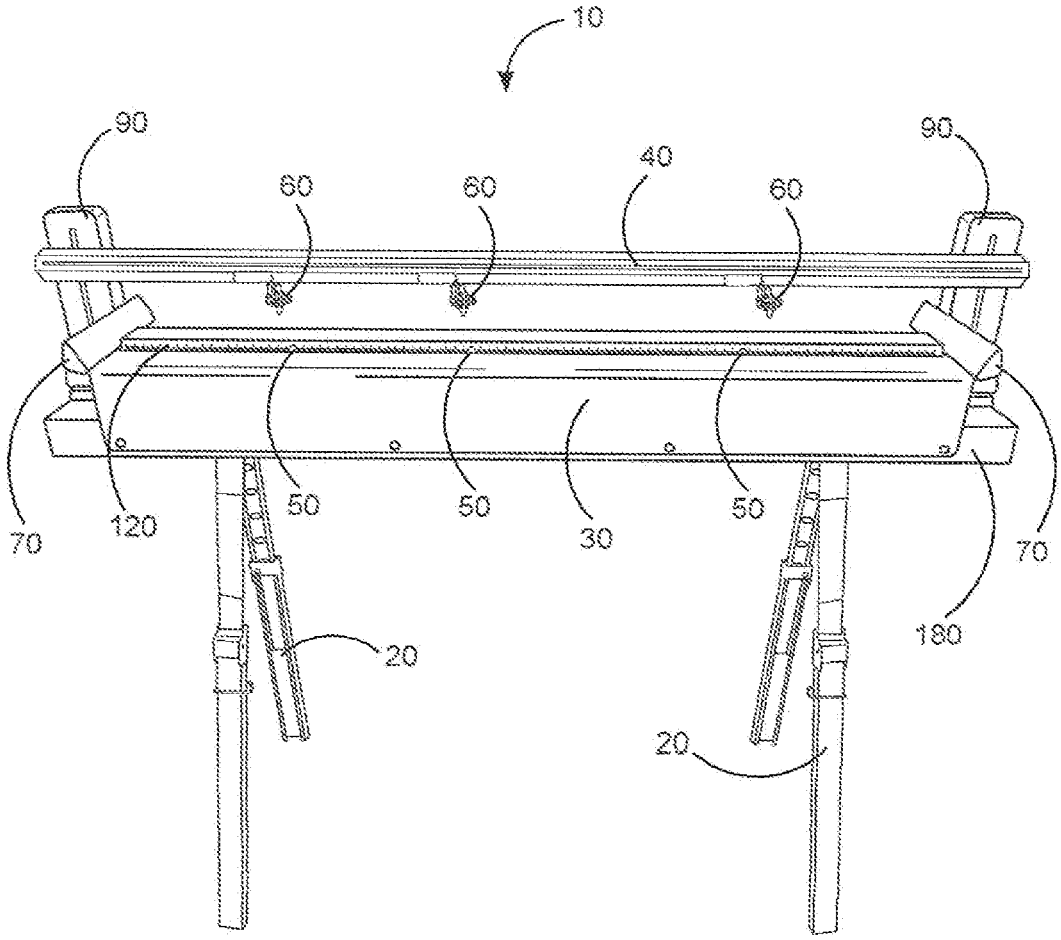
FIG. 1 is a pictorial view of one embodiment of the front of the present invention.

10 mobile rigid insulation board scorer
20 support
30 body
40 upper arm
50 lower blade
60 upper blade
70 adjustable guide rail
80 measuring device
90 column
100 slot
110 height adjustment means
120 channel
130 lower blade adjustment means
140 upper blade adjustment means
150 spacer
160 lower arm
170 bracket
180 base
190 board
200 conveyor
210 scoring line The following detailed description is of the best currently contemplated modes of carrying out the invention. The description is not to be taken in a limiting sense, but is made merely for the purpose of illustrating the general principles of the invention, since the scope of the invention is best defined by the appended claims.

Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words. Also, "connected to," "secured to," or similar language includes the definitions "indirectly connected to," "directly connected to," "indirectly secured to," and "directly secured to."

FIG. 1 illustrates one embodiment of the present invention, referred to as a mobile rigid insulation board scorer 10. The purpose of the board scorer 10 is to make a small cut, or score an upper and lower surface of insulation board that is usually used for roofing.

An upper surface of the board 190, and a lower surface of the board 190 is scored. The score is a linear surface cut, and the score on the upper surface is usually located opposite of the score on the lower surface. The score usually runs the length of the board. See FIG. 8.

In most cases the board is scored at desired widths so as to separate the board 190 in to desired widths.

FIG. 1 illustrates the scorer 10 having a support 20 to support the body 30 and other components at a height convenient for a person to place an insulation board between the body 30 and upper arm 40 that is disposed upwardly from the body 30.

Figure 6:
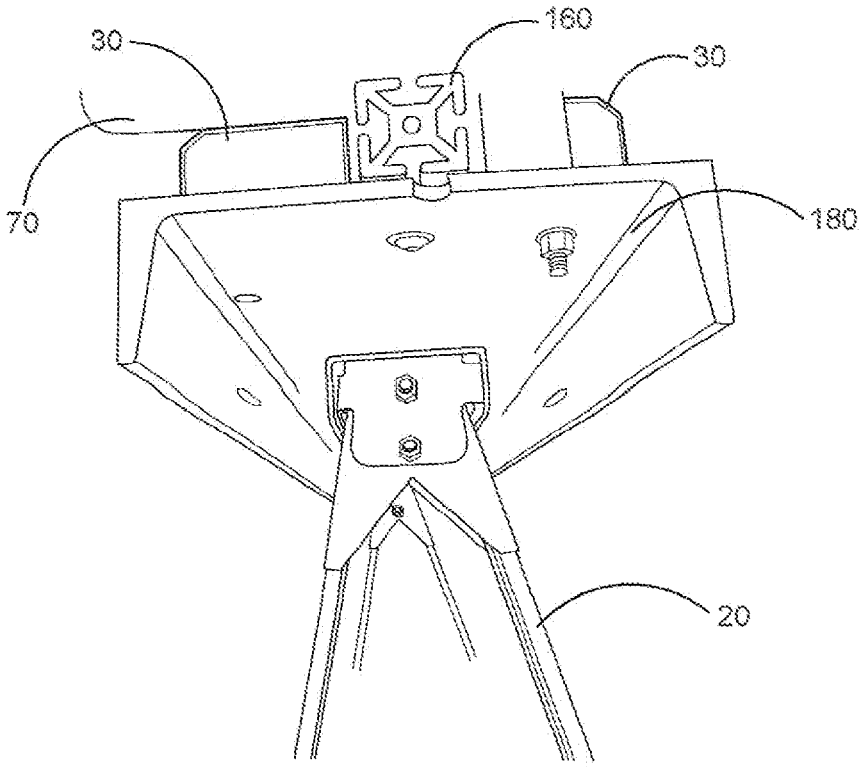
FIG. 6 is a pictorial view of another embodiment of the side of the present invention.

In one embodiment the support 20 is foldably connected to a base 180, as best seen in FIG. 6.

Figure 3:
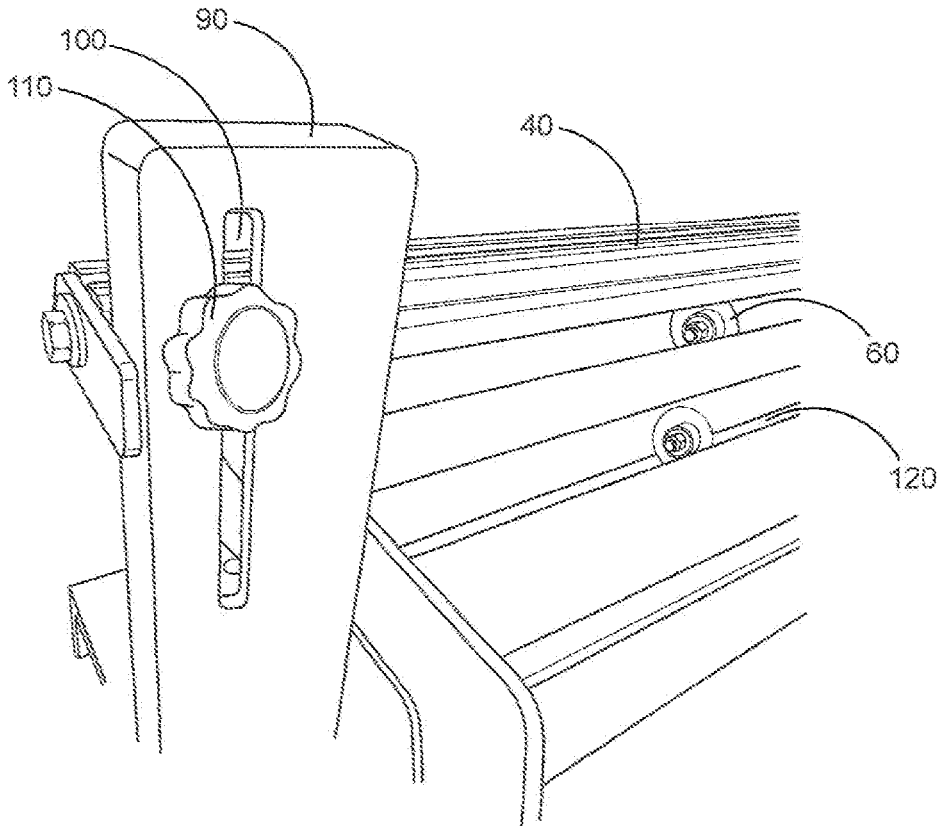
FIG. 3 is pictorial view of one embodiment of the rear of the present invention in a track and interchange.

FIG. 1 also illustrates a lower blade 50 and an upper blade 60. The upper blade 60 may be slidably disposed on an upper arm 40. The upper arm 40 may be slidably disposed on two opposed columns 90 so it may be displaced upwardly and downwardly and secured into the desired position, as best seen in FIG. 3.

A measuring device 80 may be disposed on one of the body's 30 so that the user can place the lower blades 60 or upper blades 50 at desired locations and distances.

Figure 5:
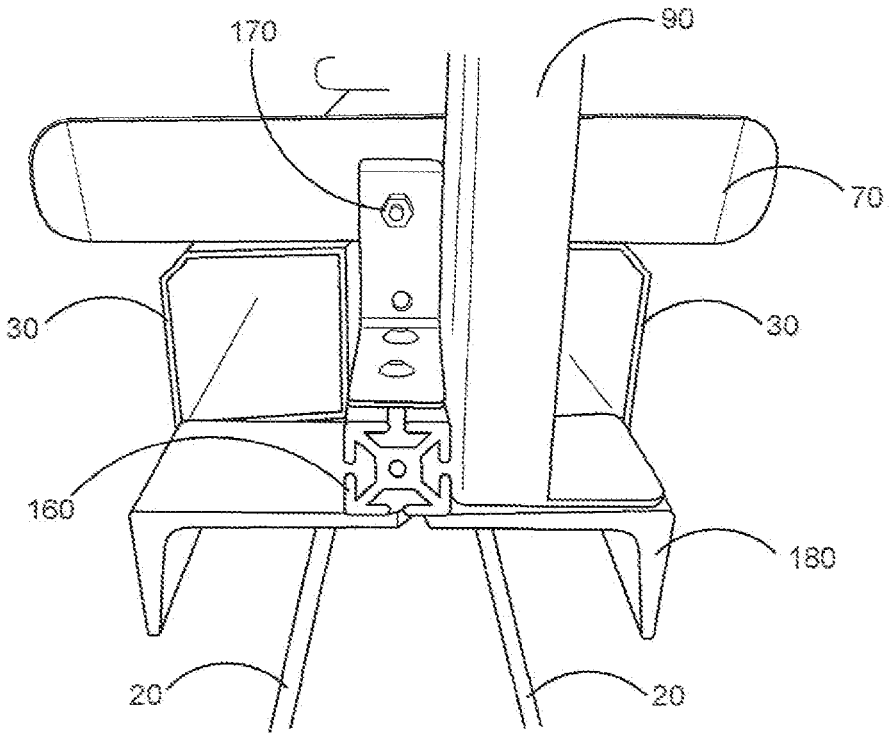
FIG. 5 is a pictorial view of an embodiment of the side of the present invention.

As illustrated in FIG. 1 a guide rail 70 may be disposed leftwardly and rightwardly on the body 30. As illustrated in FIG. 5, there may be two (2) bodies, one may be disposed in front of the other body 30. The guide rail 70 may assist the user in positioning, guiding, and moving the insulation board rearwardly through the board scorer 10. The guide rail 70 is adjustable for boards of different widths. For example the guide rail 70 may adjust from a width of 0 inches to 49 inches. The adjustable guide rail 70 can be moved by relocating the bracket 170 along the lower arm 160 as the adjustable guide rail 70 is fixed to the bracket 170.

Figure 2:
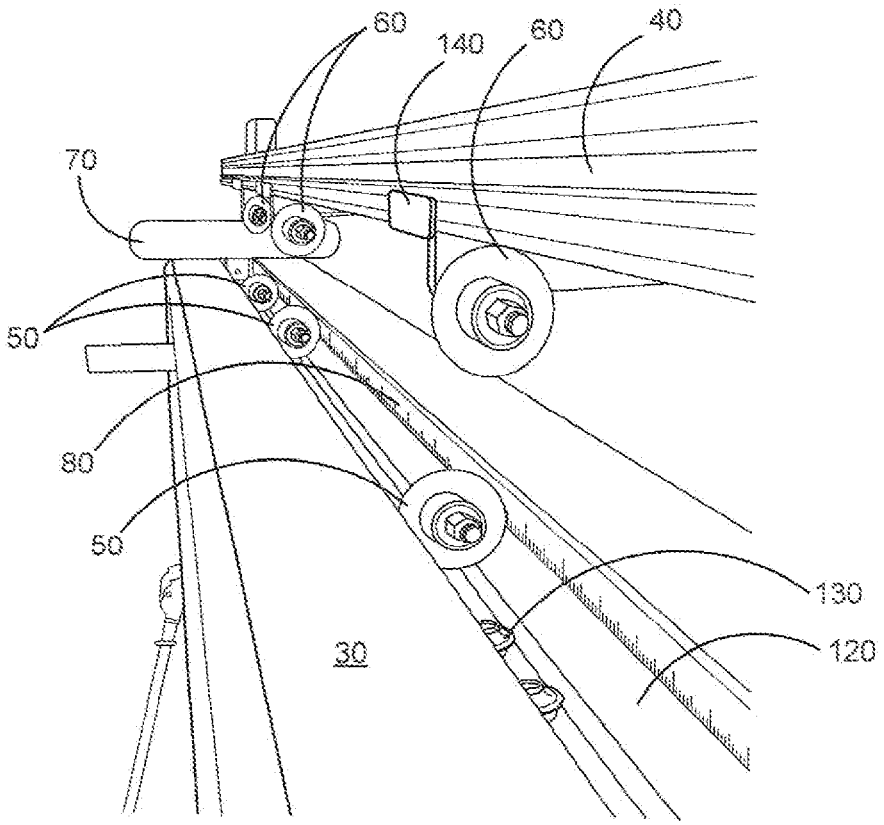
FIG. 2 is another pictorial view of one embodiment of the present invention.

As illustrated in FIG. 2 the two (2) bodies 30 may be separated by a distance to define a channel 120. The lower arm 160 may be disposed in the channel 120 on a base 180. The lower blade 50 may be slidably disposed on the lower arm 160. The upper blade 60 may be slidably disposed on the upper arm 40. The lower blade 50 may be slid along the lower arm 160 and positioned at a desired location, and then locked in place via a lower blade adjustment means 130. In one embodiment the lower blade adjustment means 130 may be a threaded fastener that secures the lower blade adjustment means 130 to the lower arm 160. Or it may be a pin that enters a hole.

Similarly the upper blade adjustment means 140 may be slid and locked in place to the upper arm 40.

FIG. 3 illustrates an embodiment of the rear of the board scorer 10. A height adjustment means 110 is illustrated. In one embodiment the height adjustment means 110 may be a threaded handle that can screw toward the column 90 until it is secured against the column 90 to secure the upper arm 40 in place.

FIG. 3 also illustrates the upper blade 60 and the channel 120.

Figure 4:
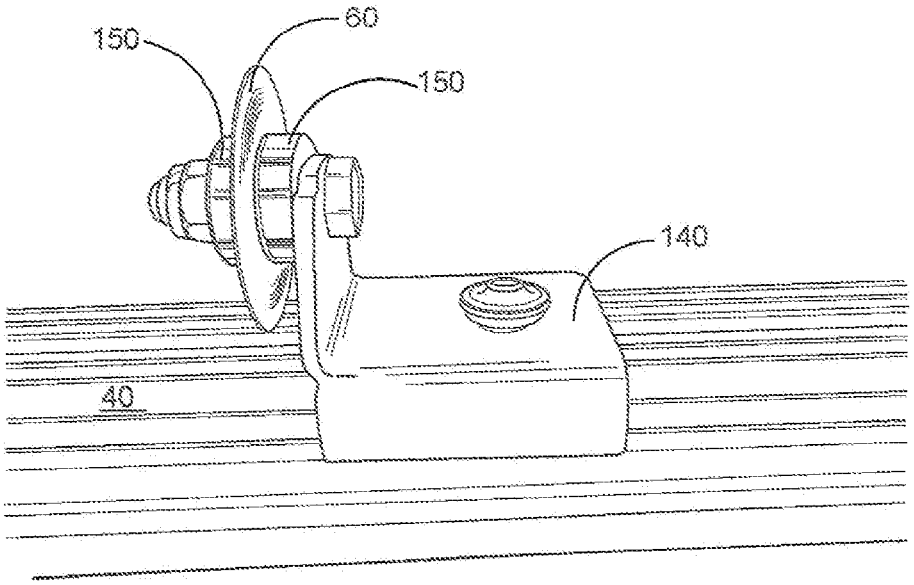
FIG. 4 is a pictorial view of an embodiment of a blade of the present invention.

FIG. 4 illustrates an embodiment of the upper blade adjustment means 140 having an Allen wrench fastener that can be rotated and contact the upper arm 40 to secure the upper blade adjustments means 140 to the upper arm 40. Likewise the upper blade 50 being secured to the upper blade adjustment means 140 is secured in position. FIG. 4 also illustrates a spacer 150 disposed on both sides of the upper blade 60.

FIG. 5 illustrates a side view of an embodiment of the board scorer 10. Each of the two (2) bodies 30 may be secured to the base 180. The lower arm 160 may be secured to the base 180. The bottom of the column 90 may also be connected to the base 180. An L-shaped bracket 170 may be secured to the top of the lower arm 160 to extend inwardly and upwardly. The guide rail 70 may be connected to the bracket 170.

FIG. 6 illustrates an embodiment of the present invention board scorer from the side and underneath. The supports 20 may be foldable and stowed entirely under the base 180 for transportation and moving of the board scorer 10. Both bodies 30 are illustrated, one body 30 in front of the other body 30 to define a channel 120, with the lower arm 16 disposed in the channel 120 and the lower arm 160 secured to the base 180. The guide rail 70 is also illustrated.

Figure 7:
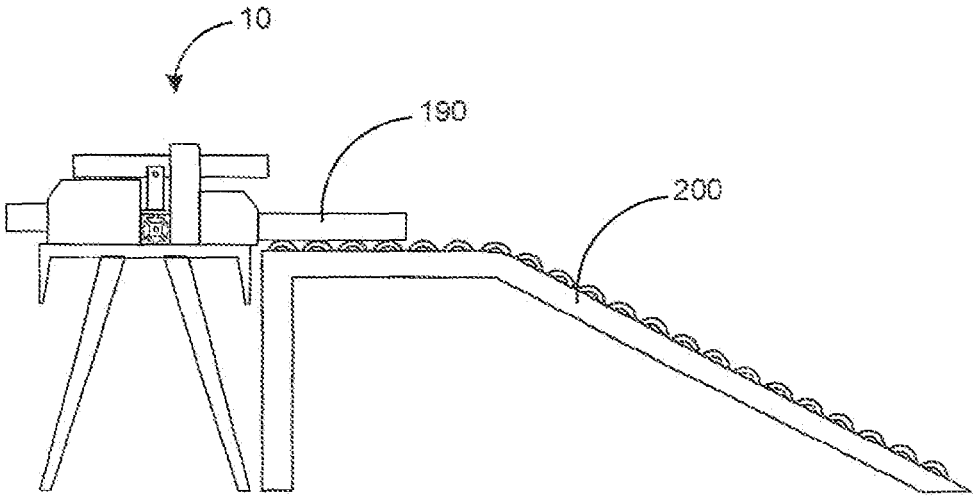
FIG. 7 is a pictorial view of another embodiment for one person use.

FIG. 7 illustrates an embodiment whereby one person can place the board in the board scorer 10, and the board 190 then slides on a conveyor 200 to be stacked one on top of the other. This allows only one person to use the board scorer 10, rather than one person feeding the board 190 through the board scorer 10, and a second person to receive the scored board 190.

Figure 8:
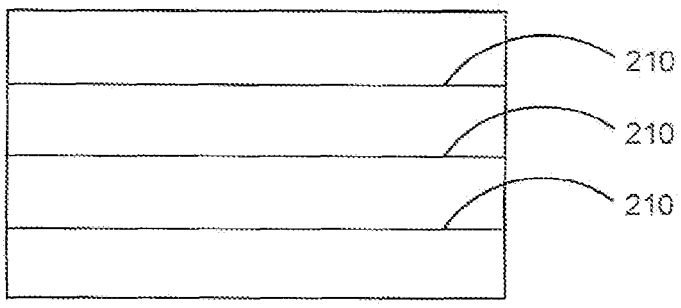
FIG. 8 is a pictorial view of a board after it is scored.

FIG. 8 illustrates one surface of the board 190 with three (3) scoring lines so the board 190 can easily be hit or impacted along the scoring lines 210 so the board 190 can be separated into four (4) separate boards.

I claim:

1. A board scorer comprising:

a base supporting a lower arm, a support column projecting upwardly of said lower arm, and an upper arm movably supported on said support column so as to be disposed vertically above said lower arm at an adjustable height;

an upper blade;

a lower blade;

said upper blade slidably disposed on said upper arm to horizontally adjust a position of said upper blade on said upper arm;

said lower blade slidably disposed on said lower arm to horizontally adjust a position of said lower blade on said lower arm, wherein said upper arm and said lower arm are vertically spaced apart by vertical adjustment of said upper arm on said support column to define a first vertical space between said upper blade and said lower blade, wherein said upper blade and said lower blade are configured for receiving a board horizontally within said first vertical space;

said board being mobile and rigid and having a board thickness defined between an upper surface and a lower surface of said board wherein said upper blade and said lower blade are configured to receive and cut said board in response to manually feeding of said board into said vertical space;

said upper blade and said lower blade having respective cutting edges which are configured to cut said board as a result of said manual feeding of said board into contact with said upper blade and said lower blade;

whereby said upper surface of said board is scored and said lower surface of said board is scored when said board is fed by manually displacing said board horizontally through said first vertical space of the board scorer between said upper blade and said lower blade wherein said first vertical space is adjustable and configured to be less than said board thickness such that said upper and lower blades cut partially through said board thickness to form surface cuts on said upper surface and said lower surface in response to said feeding which permit subsequent breaking of said board when removed from said board scorer;

a measuring device disposed near said lower arm;

horizontally oriented first and second bodies extending an entire length of said upper arm and said lower arm, which are secured to said base and define respective, upward-facing first and second support surfaces for supporting the lower surface and a weight of said board thereon, said first and second bodies being separated by a horizontal distance to define a channel which opens vertically between said first and second support surfaces, wherein at least said first body being disposed forwardly of both said upper blade and said lower blade, and said second body being disposed rearwardly of both said upper blade and said lower blade wherein said lower blade is slidably disposed in said channel and an upper portion of said lower blade projects vertically above said first and second support surfaces for partially cutting said lower surface of said board by said movement of the board into said vertical space by a user, said lower blade being slidable horizontally along said lower arm and within said channel and said upper blade being slidable horizontally along said upper arm into vertical alignment with said lower blade; and both of said first and second bodies being disposed under said upper blade to support the board wherein said upper and lower blades partially cut said upper and lower surfaces of said board by manual feeding of the board into and manual rearward movement through said first vertical space by the user to cause formation of said surface cuts.

2. The apparatus of claim 1, further comprising: said support column extending upwardly having a height adjustment means connecting said upper arm to said support column whereby said upper arm can be positioned at different distances from said lower arm to adjust said first vertical space.

3. The apparatus of claim 1, wherein said upper blade is circular and is configured to rotate about an axis in response to contact with said board and manual movement of the board by the user.

4. The apparatus of claim 1, wherein said lower blade is circular and is configured to rotate about an axis in response to contact with said board and manual movement of the board by the user.

5. The apparatus of claim 1, wherein a spacer is disposed immediately adjacent to said upper blade and to said lower blade, wherein said upper blade and said lower blade are spaced apart by said first vertical space to receive said board therethrough, and at least one said spacer on said upper blade and at least one said spacer on said lower blade being vertically spaced from and disposed opposite each other by a second vertical space proximate a thickness of said board such that said spacers are positioned to face said board and contact said board and disperse pressure on said board when being scored.

6. The apparatus of claim 1, wherein a guide rail is disposed securely on a left side of the board scorer and another guide rail is securely disposed on a right side of the board scorer to guide said board when displaced through said upper blade and said lower blade.

7. The apparatus of claim 1, wherein a guide rail is adustably connected to said lower arm and is configured to be adjustable horizontally along said lower arm for boards with different widths.

8. The apparatus of claim 1, further comprising: three upper blades and three lower blades.

9. The apparatus of claim 1, further comprising: multiple upper blades and multiple lower blades.

10. A board scorer comprising:

a base supporting a lower arm, a support column projecting upwardly of said lower arm, and an upper arm movably supported on said support column so as to be disposed vertically above said lower arm at an adjustable height;

multiple upper blades;

multiple lower blades;

said upper blades slidably disposed on said upper arm to horizontally adjust positions of said upper blades on said upper arm;

said lower blades slidably disposed on said lower arm to horizontally adjust positions of said lower blades on said lower arm and vertically align each one of said upper blades with a respective one of said lower blades, wherein said upper arm and said lower arm are vertically spaced apart to define a first vertical space between said upper blades and said lower blades such that said upper blades and said lower blades are configured for receiving a board within said first vertical space, wherein said upper blades and said lower blades are configured to manually cut said board by manual feeding and rearward movement of the board by a user between said upper blades and said lower blades;

whereby an upper surface of a board is scored and a lower surface of said board is scored when said board is manually displaced horizontally by the user through said first vertical space of the board scorer between said upper blades and said lower blades, wherein said board is mobile and rigid and has a board thickness, and wherein said first vertical space is configured to be less than said board thickness such that said upper and lower blades are configured to cut partially through said board thickness by the manual feeding and rearward movement of the board by the user to form respective upper and lower surface cuts which permit subsequent breaking of said board remote from said board scorer;

a measuring device disposed near said lower arm;

horizontally oriented, first and second bodies extending the entire length of said upper arm and said lower arm and secured to said base so as to be separated by a horizontal distance to define a channel, said first body being disposed in front of said second body with said lower blades being slidably supported on said lower arm within said channel so that the positions of said lower blades are horizontally adjustable, and said first body and said second body facing upwardly so as to be configured to support the lower surface of the board thereon;

said support column extending upwardly and having a height adjustment means whereby said upper arm can be positioned at different distances from said lower arm to adjust said first vertical space;

at least one spacer disposed immediately adjacent to said upper blade and to said lower blade to disperse pressure on the board from adjacent said upper blade and said lower blade to reduce or eliminate deformation of the board; and an adjustable guide rail is disposed securely on a left side of the board scorer and another guide rail is securely disposed on a right side of the board scorer to guide the board when displaced horizontally through said first vertical space between said upper blade and said lower blade.

11. The apparatus of claim 10, wherein each of said upper blades is circular and is configured to rotate about an axis solely in response to contact with and manual movement of the board by the user.

12. The apparatus of claim 10, wherein each of said lower blades is circular and is configured to rotate about an axis solely in response to contact with and manual movement of the board by the user.

13. A board scorer comprising:

a base supporting a lower arm, a support column projecting upwardly of said lower arm, and an upper arm movably supported on said support column so as to be disposed vertically above said lower arm at an adjustable height;

three upper blades;

three lower blades;

said upper blades slidably disposed on said upper arm to horizontally adjust positions of said upper blades on said upper arm;

said lower blades slidably disposed on said lower arm to horizontally adjust positions of said lower blades on said lower arm, wherein said upper arm and said lower arm are vertically spaced apart to define a first vertical space between said upper blades and said lower blades such that said upper blades and said lower blades are configured for receiving a board within said first vertical space, and each of said upper blades is slidable to a position opposite to a respective one of said lower blades, whereby said upper blades and said lower blades are configured to manually cut in response to said board being moved rearwardly across said upper blades and said lower blades such that an upper surface of said board is scored by said upper blades and a lower surface of said board is scored by said lower blades in response to manual horizontal displacement of the board through the board scorer between said upper blades and said lower blades by said user manually moving the board rearwardly into said first vertical space, said board being mobile and rigid and having a board thickness, and said first vertical space being configured to be set less than said board thickness such that said upper and lower blades are configured to cut partially through said board thickness to form respective surface cuts on said upper surface and said lower surface which permit subsequent breaking of said board remote from said board scorer;

a measuring device disposed near said lower arm;

two horizontally oriented bodies secured to said base and separated by a horizontal rearward distance to define a channel which opens vertically upwardly;

said horizontally oriented bodies comprising a first body disposed in front of a second body wherein said first body and said second body extend the entire length of said upper arm and said lower arm to vertically support said board from below and define said channel therebetween;

said three lower blades being slidably supported on said lower arm so as to be disposed between said first body and said second body and being supported in said channel so as to project upwardly above said first body and said second body to form said respective surface cuts in said board;

said support column extending upwardly from said lower arm and having a height adjustment means whereby said upper arm is configured to be positioned at different distances from said lower arm to adjust said first vertical space to accommodate different board thicknesses; and an adjustable guide rail is disposed securely on a left side of the board scorer and another guide rail is securely disposed on a right side of the board scorer to guide the board when displaced horizontally through said upper blades and said lower blades.

14. The apparatus of claim 13 wherein each of said upper blades is circular and can rotate about an axis in response to manual movement of the board by the user.

15. The apparatus of claim 13 wherein each of said lower blades is circular and can rotate about an axis in response to manual movement of the board by the user.

* * * * *